US005159860A

United States Patent [19]

Pietras

[11] Patent Number: 5,159,860

[45] Date of Patent: Nov. 3, 1992

[54] ROTARY FOR A POWER TONG

[75] Inventor: Bernd-Georg Pietras, Wedemark, Fed. Rep. of Germany

[73] Assignee: Weatherford/Lamb, Inc., Houston, Tex.

[21] Appl. No.: 805,090

[22] Filed: Dec. 11, 1991

[30] Foreign Application Priority Data

Apr. 12, 1991 [GB] United Kingdom ..... 9107826

[51] Int. Cl.[5] ..... B25B 17/00

[52] U.S. Cl. ..... 81/57.19; 81/57.3; 81/57.44; 173/218

[58] Field of Search ..... 81/57.15, 57.18-57.21, 81/57.3, 57.44; 91/167 R, 519; 173/218

[56] References Cited

U.S. PATENT DOCUMENTS 2,453,369 11/1948 Grable et al. .
3,021,739 2/1962 Grundmann .
3,371,562 3/1968 Kelley .
3,589,742 6/1971 Flick .
4,082,017 4/1978 Eckel .
4,092,881 6/1978 Jurgens et al. .
4,280,397 7/1981 Peveto .
4,727,781 3/1988 Yuehui et al. ..... 81/57.19 X
4,836,064 6/1989 Slator .
5,081,888 1/1992 Schulze-Beck .

OTHER PUBLICATIONS 1990-91 General Services and Products Catalog Weatherford, 1989.

*Primary Examiner*—James G. Smith
*Attorney, Agent, or Firm*—Guy McClung

[57] ABSTRACT

A rotary for a power tong which, in one aspect, has a master piston and cylinder which, when actuated, delivers hydraulic fluid to one or more slave hydraulic piston and cylinders which apply one or more active jaws against a pipe. The master piston and cylinder can be depressed by a plunger mounted on top of the tong housing and the active jaws can be released by opening one or both valves mounted on the rotary and actuable by depressing a ring mounted on the top of the tong housing.

13 Claims, 3 Drawing Sheets

ROTARY FOR A POWER TONG

BACKGROUND OF THE INVENTION

1. Field of the Invention

This invention is directed to a rotary for use in a power tong.

2. Description of Related Art

In drilling operations it is necessary to connect and disconnect successive lengths of tubulars such as drill pipe which are provided with threaded connections. The tools used for holding the pipes while they are being screwed together are known as tongs. Power tongs generally include a rotary for rotating the pipe while a back-up tong holds the pipe.

Tongs are generally provided with one or more jaws which can be moved into engagement with a pipe. In one typical arrangement, two "passive" jaws are fixed in a tong and a third "active" jaw is advanced towards or retracted away from a pipe as desired. In one power tong the active jaw is mounted in a jaw holder, the radial extremity of which is provided with a roller which rests on a cam surface formed on a rotary. When the rotary rotates relative to the jaw holder the roller rides along the cam surface and urges the jaw against the pipe with a force which is a function of the slope of the cam surface. Once the jaw is firmly applied the pipe and rotary rotate in unison.

Such power tongs can only be used with pipes having a relatively small range of diameters. In order to accommodate substantially larger or smaller diameter pipes it is necessary to change the cam surface either completely or by adding wedges. This is a time-consuming and expensive procedure.

In order to overcome this problem it has been proposed to provide a rotary for use in a power tong, which rotary comprises a slave hydraulic piston and cylinder, a jaw carrier associated with the slave hydraulic piston and cylinder, and means to selectively retain hydraulic fluid in the slave hydraulic piston and cylinder.

In this arrangement, a master hydraulic piston and cylinder are mounted alongside the rotary. In use, the master hydraulic piston and cylinder are connected to the slave piston and cylinder by a hose having a releasable coupling. Hydraulic fluid is then pumped from the master hydraulic piston and cylinder to the slave piston and cylinder to apply the jaw(s). Once the desired pressure is reached, valves on either side of the coupling are closed and the releasable coupling is disconnected to enable the rotary to be rotated. In order to release the jaws the hose is reconnected, the valves are opened and the hydraulic fluid is allowed to return to a reservoir.

The repeated coupling and disconnection of the releasable coupling is a time-consuming process and great care has to be taken to ensure that the releasable couplings are correctly attached and that the hoses connected thereto are not damaged.

There has long been a need for a tong which does not require such time-consuming coupling. There has long been a need for a tong in which hydraulic fluid need not return to a reservoir. There has long been a need for such a tong which can efficiently and effectively handle pipe of varying diameters.

SUMMARY OF THE PRESENT INVENTION

The present invention in one embodiment provides a rotary with a master hydraulic piston and cylinder and valve apparatus or locking apparatus to selectively retain hydraulic fluid in a slave hydraulic piston and cylinder. A jaw holder with a jaw is operatively associated with the rotary. Preferably, the apparatus includes two valves connected in parallel and a hydraulic accumulator placed in communication with the slave hydraulic piston and cylinder to help compensate for leakage and absorb shock loads transmitted through a jaw holder.

In one preferred embodiment, the master hydraulic piston and cylinder include a major cylinder and a minor cylinder, wherein:

(a) the major cylinder communicates with a pressure relief valve and is connected to the slave hydraulic piston and cylinder via a non-return valve; and (b) the minor cylinder is connected to the slave piston and cylinder via a non-return valve;

the arrangement being such that, in use, the master hydraulic piston and cylinder is capable of delivering hydraulic fluid to the slave piston and cylinder at a first volumetric flow rate until the pressure in the slave piston and cylinder reaches a first pressure at which a pressure relief valve opens, and then at a second volumetric flow rate lower than the first volumetric flow rate, but at a pressure higher than the first pressure.

The present invention also provides in one embodiment a power tong provided with a rotary in accordance with the present invention. The power tong includes a tong housing, and a plunger mounted on the tong housing and movable to actuate the master hydraulic piston and cylinder, preferably a predetermined number of times. The plunger forms part of a hydraulic actuator and an apparatus is provided to inhibit operation of the hydraulic actuator when the plunger is not aligned with said piston.

If desired, the jaw can be formed as an integral part of the jaw holder although it will normally be formed as a separate part which can be mounted on the jaw holder. It will be appreciated that with the arrangement described the pressure which the jaws apply to the pipe can be accurately controlled and, once set, remains constant. Thus, power tongs incorporating a rotary according to the present invention can be quickly adapted to handle pipes of the same diameter but made from very different materials, or pipes of different diameters.

In another preferred embodiment, a master hydraulic piston and cylinder are arranged to control a plurality of slave hydraulic cylinders disposed circumjacent the pipe opening in a tong and associated with a multiplicity of jaw holders. It will be appreciated that such an arrangement applies a substantially uniform gripping pressure to the circumference of the pipe.

When one or two valves are provided to selectively retain hydraulic fluid in the slave hydraulic piston and cylinder the or both valves are preferably actuable by a ring mounted on the tong housing and movable into contact with the valves.

It is, therefore, an object of the present invention to provide new, useful, unique, efficient and effective devices and methods for rotating tubular members.

Another object of the present invention is the provision of such devices and methods for use with a variety of pipe with different diameters.

Yet another object of the present invention is the provision of such methods and devices which can relatively quickly be adapted to pipe of varying diameters.

An additional object of the present invention is to provide such methods and devices for accurately controlling the pressure with which jaws of the devices are applied to a tubular to be rotated.

Another object of the present invention is the provision of such devices and methods which have a plurality of jaws that apply a uniform gripping pressure to a tubular.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

Filed on even date herewith are two applications co-assigned with the present invention, both entitled Power Tong copies of which are submitted herewith and fully incorporated herein.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

For a better understanding of the present invention, reference will now be made, by way of example, to the accompanying drawings, in which.

DESCRIPTION OF EMBODIMENTS PREFERRED AT THE TIME OF FILING FOR THIS PATENT

Figure 1:
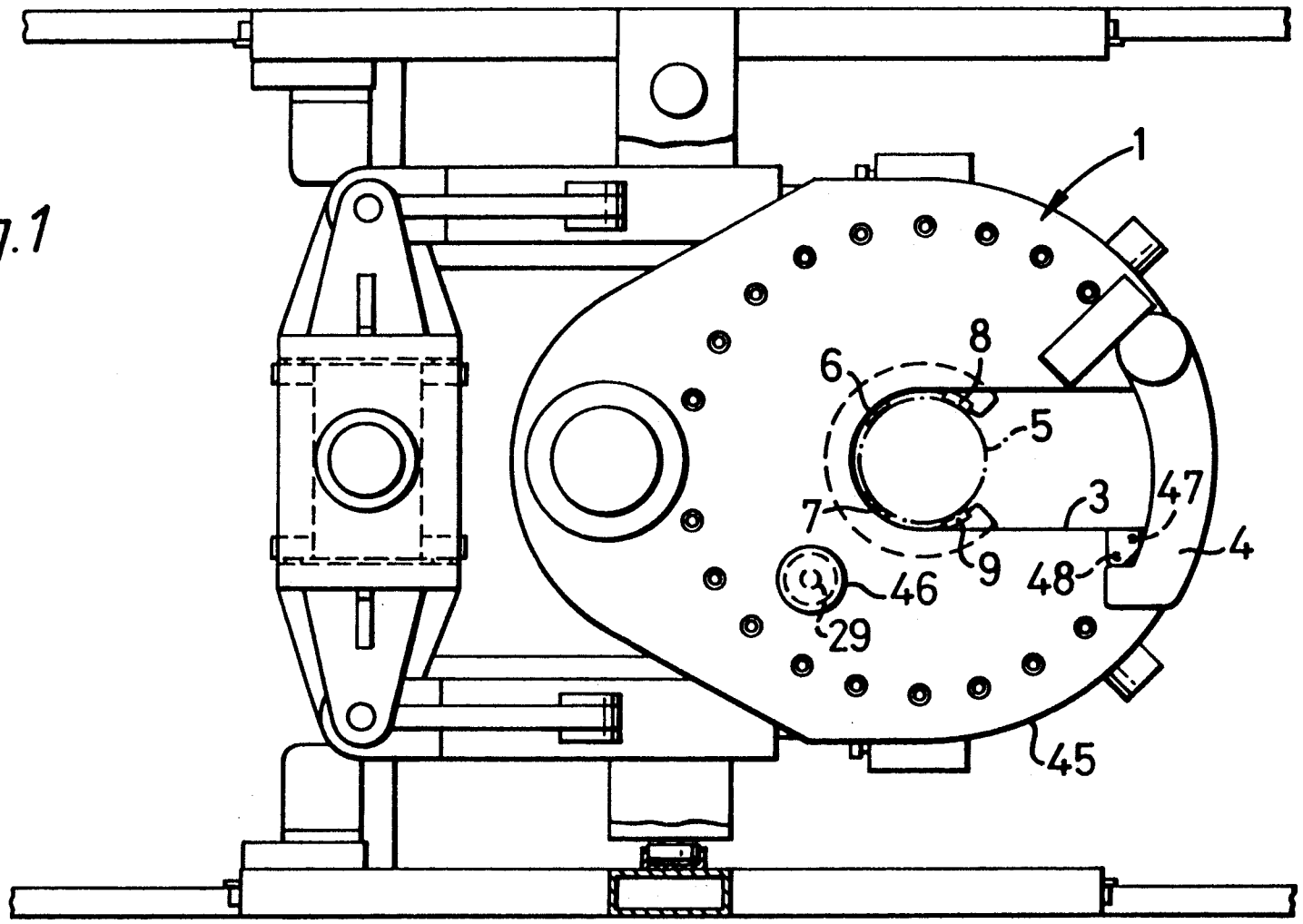
FIG. 1 is a top plan view of a power tong in accordance with the invention.
Figure 2:
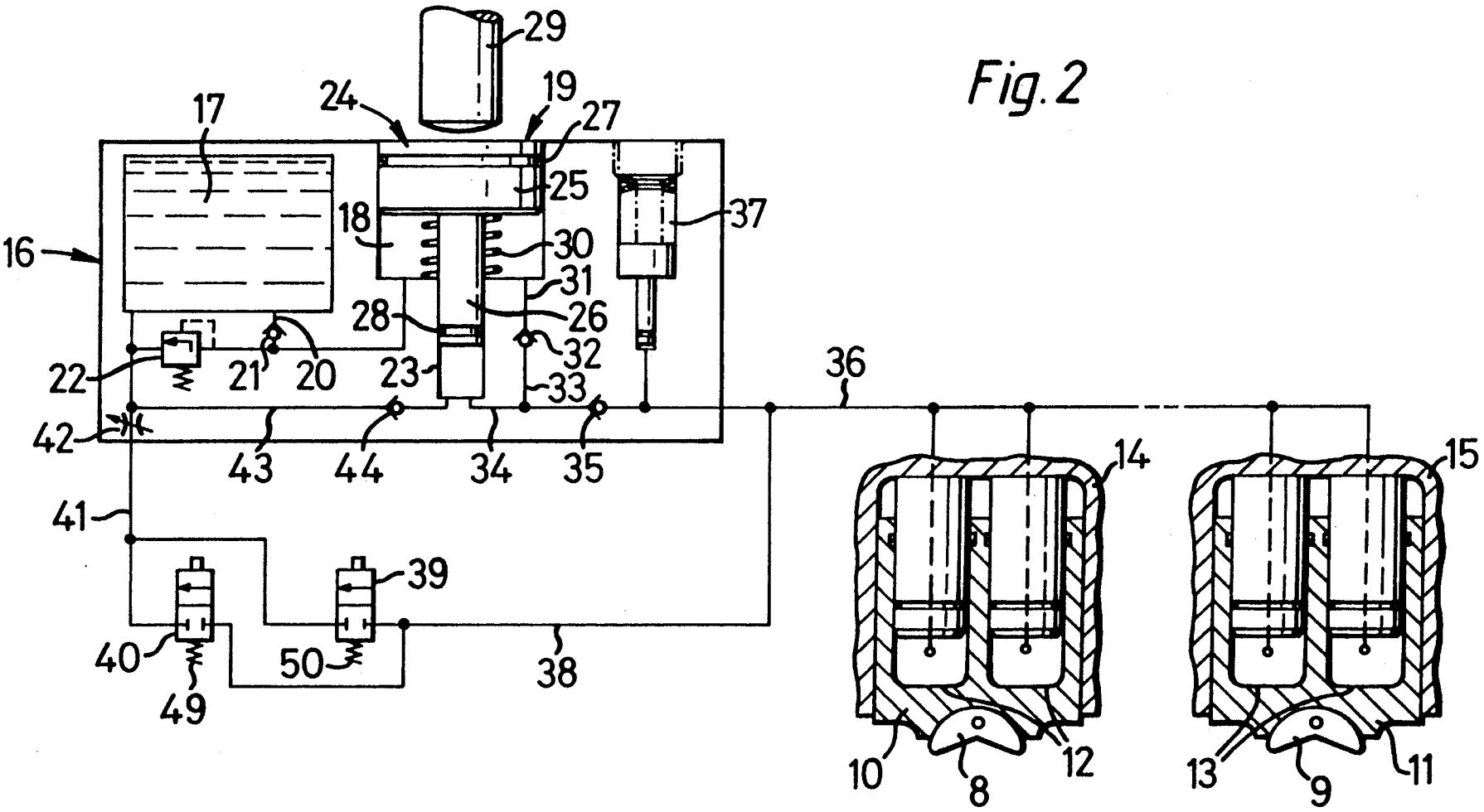
FIG. 2 is a flow sheet showing the interconnection of certain parts in the rotary of the power tong shown in FIG. 1.
Figure 3:
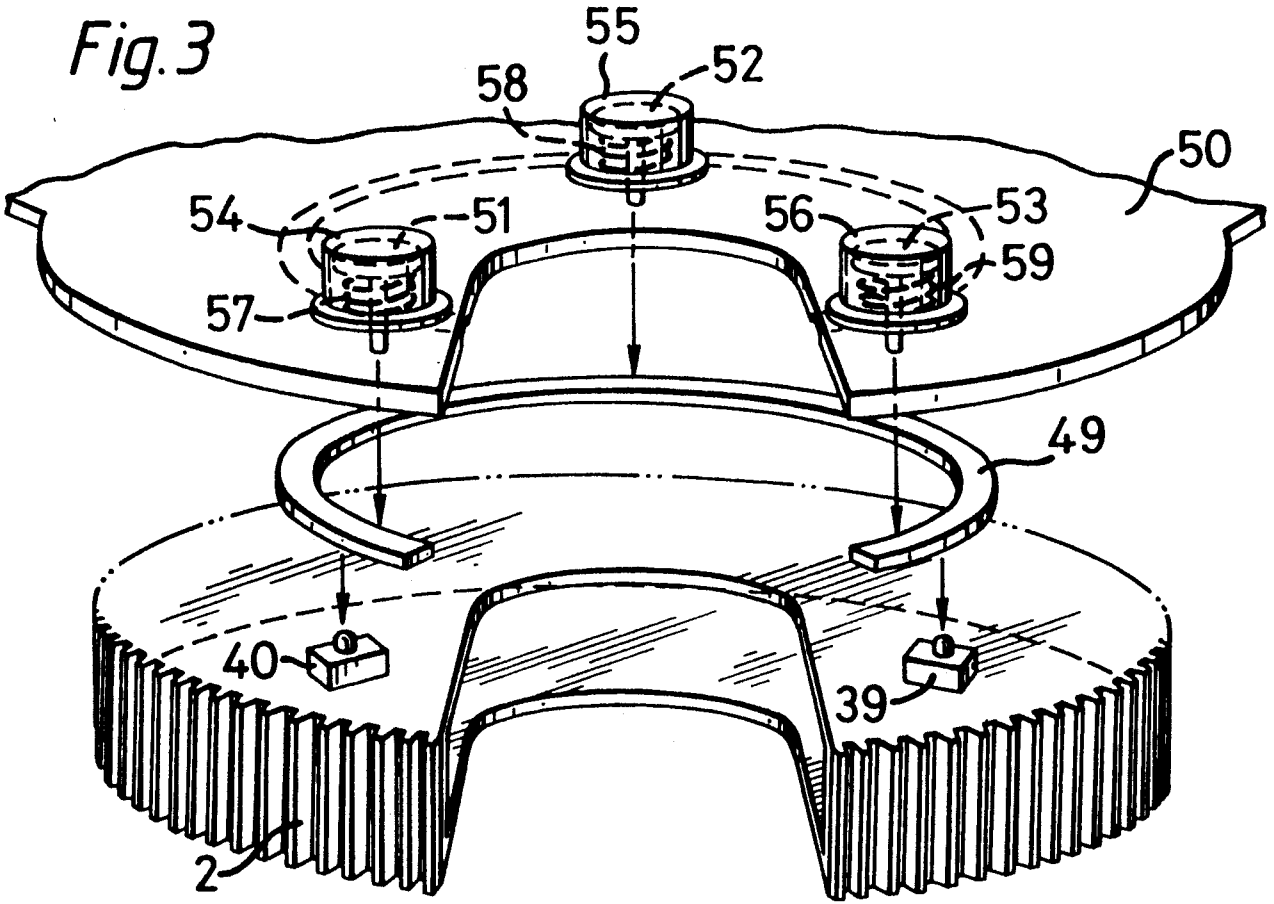
FIG. 3 is a schematic exploded view of part of the power tong shown in FIG. 1.

Referring to the drawings, there is shown a power tong which is generally identified by reference numeral 1. The power tong 1 houses a rotary 2 having an opening 3 closed by a gate 4. The gate 4 can be opened and the power tong 1 can be moved so that a pipe 5, shown in outline, can be received in the center of the power tong 1. The pipe 5 is gripped in this position by two passive jaws 6, 7 and two active jaws 8, 9 which are shown fully advanced in their pipe gripping position. The active jaws 8, 9 are carried on jaw carriers 10, 11 which form the cylinders 12, 13 of twin slave piston-and-cylinder assemblies 14, 15.

A hydraulic control assembly 16 is also located in the rotary 2. The hydraulic control assembly 16 has a reservoir 17 which is connected to the major cylinder 18 of a master hydraulic piston and cylinder 19 by a line 20 having a non-return valve 21 mounted therein. A pressure relief valve 22 is situated downstream of the non-return valve 21 and, when open, returns hydraulic fluid to the reservoir 17.

The master hydraulic piston and cylinder 18 is divided into major cylinder 19 and minor cylinder 23. The piston 24 comprises a major land 25 which slides in the major cylinder 18 and a spool 26 which slides in the minor cylinder 23. The major land 25 is provided with a seal 27 and the spool 26 is provided with a seal 28. The piston 24 can be depressed against the restoring action of a spring 30 by a plunger 29.

A delivery line 31 connects the major cylinder 18 to a non-return valve 32. A delivery line 33 connects the non-return valve 32 to a delivery line 34 leaving the bottom of the minor cylinder 23 and thence to a non-return valve 35. A supply pipe 36 connects the non-return valve 35 to the slave twin piston and cylinder assemblies 14 and 15.

A pneumatic accumulator 37 is connected to the supply pipe 36 as is a return line 38 which is connected to two valves 39 and 40 which are connected in parallel. A return line 41 is arranged to return hydraulic fluid to the reservoir 17 via a variable orifice 42.

Finally, a line 43 connects the reservoir 17 to minor cylinder 23 via a line 43 and a non-return valve 44.

With the exception of the plunger 29 all the components thus far described are mounted in the rotary 2.

At the commencement of a coupling operation, the rotary 2 is rotated until its opening 3 is aligned with the opening in the tong housing 45 as shown in FIG. 1. In this position, the plunger 29, which is contained within a hydraulic actuator 46, is disposed directly above the piston 24 of the master hydraulic piston and cylinder 19. At this stage, active jaws 8 and 9 are fully retracted so that when the gate 4 is opened the power tong 1 can be slipped over the pipe 5 until it rests against the passive jaws 6 and 7, the positions of which have been pre-set according to the diameter of the pipe 5. Once the pipe 5 is in position, a signal is sent to the hydraulic actuator 46 to depress the plunger 29 a predetermined number of times in accordance with information stored on a computer (not shown). Execution of this instruction is delayed while an inquiry is sent to position sensors 47 and 48 to confirm that the rotary 2 is in a position such that the plunger 29 is above the piston 24.

Assuming all is well, the plunger depresses piston 24. At this time, both the major cylinder 18 and the minor cylinder 23 are full of hydraulic fluid which has entered via line 20 and non-return valve 21 and via line 43 and non-return valve 44 respectively. The hydraulic fluid passes to the supply pipe 36 and enters the cylinders 12, 13 of the twin piston and cylinder assemblies 14 and 15. This displaces the jaw carriers 10, 11 radially inwardly. During this time, the valves 39 and 40 are closed as shown.

As the active jaws 8, 9 move into engagement with the pipe 5, the pressure in the supply pipe 36 increases. At a certain pressure, the pressure relief valve 22 opens so that when the plunger 29 is depressed, the hydraulic fluid in the major cylinder 18 is returned to the reservoir 17. However, the hydraulic fluid in the minor cylinder 23 is still directed to the supply pipe 36. The hydraulic fluid from the minor cylinder 23 is prevented from flowing to the major cylinder 18 by the non-return valve 32.

It will be appreciated that the arrangement described provides a relatively large volume of hydraulic fluid to be supplied to the two piston-and-cylinder assemblies 14 and 15 at a first pressure. However, when the pressure reaches a certain level, the arrangement delivers a small volume at a second pressure higher than the first pressure. It will be noted that the gripping force is determined by the master hydraulic piston and cylinder 19.

When it is desired to release the pipe, one or both of the valves 39 and 40 are opened against the bias of springs 49, 50 to allow hydraulic fluid from the twin piston and cylinder assemblies 14 and 15 to return to the reservoir 17.

During a tightening operation, the rotary 2 may be stopped in any position relative to the tong housing 45. In order to actuate at least one of the valves 39, 40 a ring 49 is provided which is supported from the cover 50 of the tong housing 45 by the pistons 51, 52, 53 of three hydraulic actuators 54, 55, 56. The pistons 51, 52, 53 are biased upwardly by springs 57, 58, 59 respectively.

When it is desired to open valves 39 and 40, hydraulic fluid is introduced into the top of the hydraulic actuators 54, 55 and 56 and displaces the ring 49 downwardly. By using two valves 39 and 40, the jaws 6 and 7 can be released irrespective of the position of the rotary 2 relative to the tong housing 45.

Various modifications to the arrangement disclosed are possible within the scope of this invention. For example, only one active jaw may be present. Alternatively, the pipe can be surrounded by a multiplicity of active jaws each operable by a common master hydraulic piston and cylinder.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A rotary for use in a power tong, the rotary comprising a rotary body, a slave hydraulic piston and cylinder mounted on the body, a jaw carrier interconnected with the slave hydraulic piston and cylinder, a master hydraulic piston and cylinder interconnected with the slave hydraulic piston and cylinder, and retaining means for selectively retaining hydraulic fluid in the slave hydraulic piston and cylinder.

2. The rotary as claimed in claim 1, wherein said retaining means comprises at least one valve for controlling the flow of hydraulic fluid from the slave hydraulic piston and cylinder.

3. The rotary as claimed in claim 2 wherein the at least one valve comprises two valves connected in parallel.

4. The rotary as claimed in claim 1 including a pneumatic accumulator in fluid communication with the slave hydraulic piston and cylinder.

5. The rotary as claimed in claim 1 wherein the master hydraulic piston and cylinder comprises a major cylinder and a minor cylinder wherein:

the major cylinder communicates with a pressure relief valve and is connected to the slave hydraulic piston and cylinder via a non-return valve; and the minor cylinder is connected to the slave piston and cylinder via a non-return valve, the master hydraulic piston and cylinder delivering hydraulic fluid to the slave piston and cylinder at a first volumetric flow rate until the pressure in the slave piston and cylinder reaches a first pressure at which the pressure relief valve opens, and then at a second volumetric flow rate lower than the first volumetric flow rate but at a pressure higher than the first pressure.

6. A rotary for use in a power tong, the rotary comprising a rotary body, a slave hydraulic piston and cylinder mounted on the body, a jaw carrier interconnected with the slave hydraulic piston and cylinder, a master hydraulic piston and cylinder interconnected with the slave hydraulic piston and cylinder, two valves connected in parallel for controlling the flow of hydraulic fluid from the slave hydraulic piston and cylinder, a pneumatic accumulator in fluid communication with the slave hydraulic piston and cylinder, and the master hydraulic piston and cylinder comprising a major cylinder and a minor cylinder wherein the major cylinder communicates with a pressure relief valve and is connected to the slave hydraulic piston and cylinder via a non-return valve;

the minor cylinder is connected to the slave piston and cylinder via a non-return valve, and the master hydraulic piston and cylinder deliver hydraulic fluid to the slave piston and cylinder at a first volumetric flow rate until the pressure in the slave piston and cylinder reaches a fist pressure at which the pressure relief valve opens, and then at a second volumetric flow rate lower than the first volumetric flow rate but at a pressure higher than the first pressure.

7. A power tong comprising a tong housing, a rotary movably mounted in the tong housing, a slave hydraulic piston and cylinder mounted on the rotary, a jaw carrier interconnected with the slave hydraulic piston and cylinder, a master hydraulic piston and cylinder interconnected with the slave hydraulic piston and cylinder, and retaining means for selectively retaining hydraulic fluid in the slave hydraulic piston and cylinder.

8. The power tong of claim 7 comprising also a plunger mounted on the tong housing and movable to actuate the master piston and cylinder.

9. The power tong of claim 8 wherein the plunger forms part of an hydraulic actuator and means are provided for inhibiting operation of the hydraulic actuator until the plunger is aligned with the master hydraulic piston and cylinder.

10. The power tong of claim 7 including a plurality of slave hydraulic cylinders disposed on the rotary circumjacent a pipe opening in the tong and connected to a multiplicity of jaw holders.

11. The power tong of claim 7 wherein the retaining means comprises two valves connected in parallel for controlling the flow of hydraulic fluid from the slave hydraulic piston and cylinder, and at least one valve for controlling the flow of hydraulic fluid to the slave hydraulic piston and cylinder.

12. The power tong as claimed in claim 7 wherein the master hydraulic piston and cylinder comprises a major cylinder and a minor cylinder wherein the major cylinder communicates with a pressure relief valve and is connected to the slave hydraulic piston and cylinder via a non-return valve; and the minor cylinder is connected to the slave piston and cylinder via a non-return valve, the master hydraulic piston and cylinder delivering hydraulic fluid to the slave piston and cylinder at a first volumetric flow rate until the pressure in the slave piston and cylinder reaches a first pressure at which the pressure relief valve opens, and then at a second volumetric flow rate lower than the first volumetric flow rate but at a pressure higher than the first pressure.

13. A power tong comprising a tong housing, a rotary movably mounted in the tong housing, a plurality of slave hydraulic pistons and cylinders mounted on the rotary circumjacent a pipe opening in the tong, a jaw carrier interconnected with each of the slave hydraulic pistons and cylinders, a master hydraulic piston and cylinder interconnected with the slave hydraulic piston and cylinder, a plunger mounted on the tong housing and movable to actuate the master piston and cylinder, the plunger forming part of an hydraulic actuator, means for inhibiting operation of the hydraulic actuator until the plunger is aligned with the master hydraulic piston and cylinder, and two valves connected in parallel for controlling the flow of hydraulic fluid from the slave hydraulic piston and cylinder.

* * * * *